US010497301B2

(12) United States Patent
Watsuda

(10) Patent No.: US 10,497,301 B2
(45) Date of Patent: Dec. 3, 2019

(54) LIGHT-EMITTING DEVICE (LED) AND LED DISPLAYING CIRCUIT

(71) Applicant: Innolux Corporation, Miao-Li County (TW)

(72) Inventor: Hirofumi Watsuda, Miao-Li County (TW)

(73) Assignee: Innolux Corporation, Miao-Li County (TW)

( * ) Notice: Subject to any disclaimer, the term of this patent is extended or adjusted under 35 U.S.C. 154(b) by 86 days.

(21) Appl. No.: 15/488,517

(22) Filed: Apr. 17, 2017

(65) Prior Publication Data

US 2018/0053460 A1 Feb. 22, 2018

Related U.S. Application Data

(60) Provisional application No. 62/376,925, filed on Aug. 19, 2016, provisional application No. 62/415,542, filed on Nov. 1, 2016.

(51) Int. Cl.
*G09G 3/20* (2006.01)
*G09G 3/32* (2016.01)

(52) U.S. Cl.
CPC ..... *G09G 3/2074* (2013.01); *G09G 3/32* (2013.01); *G09G 2300/0452* (2013.01); *G09G 2300/0842* (2013.01); *G09G 2320/0666* (2013.01)

(58) Field of Classification Search
None
See application file for complete search history.

(56) References Cited

U.S. PATENT DOCUMENTS

| | | | | |
|---|---|---|---|---|
| 6,429,601 | B1 * | 8/2002 | Friend | G09G 3/2014 313/505 |
| 8,803,791 | B2 | 8/2014 | Sugita et al. | |
| 2005/0116903 | A1 * | 6/2005 | Shin | G09G 3/325 345/76 |
| 2010/0033513 | A1 * | 2/2010 | Choi | G09G 3/3406 345/690 |
| 2011/0216056 | A1 * | 9/2011 | Yoo | G09G 3/32 345/212 |
| 2013/0127924 | A1 * | 5/2013 | Lee | G09G 3/32 345/690 |
| 2017/0345376 | A1 * | 11/2017 | Tani | G09G 3/3233 |

* cited by examiner

*Primary Examiner* — Matthew Yeung
(74) *Attorney, Agent, or Firm* — JCIPRNET

(57) ABSTRACT

A light-emitting device (LED) includes a primary driving circuit and a pixel. The primary driving circuit receives a system high voltage, a data signal, and a scan signal from a scan line, wherein the primary driving circuit has an output terminal. The pixel includes a plurality of light-emitting sub-pixel circuits. Each of the light-emitting sub-pixel is coupled to the output terminal of the primary driving circuit. Wherein, a frame period includes multiple equal fields, the light-emitting sub-pixel circuits are respectively corresponding to the fields and are activated according to a sequence as assigned. The light-emitting device display includes a plurality of light-emitting sub-pixel circuits are activated in raw, in column or both according to a sequence as assigned.

7 Claims, 9 Drawing Sheets

Field_A

| | | | | | |
|---|---|---|---|---|---|
| R | B | G | R | B | G |
| B | G | R | B | G | R |
| G | R | B | G | R | B |
| R | B | G | R | B | G |
| B | G | R | B | G | R |
| G | R | B | G | R | B |

Field_B

| | | | | | |
|---|---|---|---|---|---|
| G | R | B | G | R | B |
| R | B | G | R | B | G |
| B | G | R | B | G | R |
| G | R | B | G | R | B |
| R | B | G | R | B | G |
| B | G | R | B | G | R |

Field_C

| | | | | | |
|---|---|---|---|---|---|
| B | G | R | B | G | R |
| G | R | B | G | R | B |
| R | B | G | R | B | G |
| B | G | R | B | G | R |
| G | R | B | G | R | B |
| R | B | G | R | B | G |

FIG. 11

Field_A

| | | | | | |
|---|---|---|---|---|---|
| R | B | G | R | B | G |
| R | B | G | R | B | G |
| R | B | G | R | B | G |
| R | B | G | R | B | G |
| R | B | G | R | B | G |
| R | B | G | R | B | G |

Field_B

| | | | | | |
|---|---|---|---|---|---|
| G | R | B | G | R | B |
| G | R | B | G | R | B |
| G | R | B | G | R | B |
| G | R | B | G | R | B |
| G | R | B | G | R | B |
| G | R | B | G | R | B |

Field_C

| | | | | | |
|---|---|---|---|---|---|
| B | G | R | B | G | R |
| B | G | R | B | G | R |
| B | G | R | B | G | R |
| B | G | R | B | G | R |
| B | G | R | B | G | R |
| B | G | R | B | G | R |

FIG. 12

LIGHT-EMITTING DEVICE (LED) AND LED DISPLAYING CIRCUIT

CROSS-REFERENCE TO RELATED APPLICATION

This application claims the priority benefits of U.S. provisional application Ser. No. 62/376,925, filed on Aug. 19, 2016 and U.S. provisional application Ser. No. 62/415,542, filed on Nov. 1, 2016. The entirety of each of the above-mentioned patent applications is hereby incorporated by reference herein and made a part of this specification.

BACKGROUND OF THE INVENTION

1. Field of the Invention

The present invention generally relates to light-emitting device (LED) display panel, in particular, to a LED displaying circuit.

2. Description of Related Art

As usually known, the LED such as organic LED (OLED) or micro-LED can be fabricated to emit red light, green light, or blue light, which is one of the three primary color lights. One pixel usually comprises three sub-pixels tightly put together as one pixel. The three sub-pixels respectively display the red light, green light, and blue light according to the gray levels. The primary color lights as displayed are mixed to form a displayed color for one pixel. A large number of pixels, corresponding to the resolution, are displayed to form a colourful image.

The gray level to the LED is achieved by control the driving current flowing through the LED. The stronger the driving current, the brighter the LED. So, the gray level for each sub-pixel in digital image is converted into a corresponding driving current to drive the LED.

However, the relation between the luminance and the driving current of the LED is not ideally linear. Particularly, when the driving current is low, the performance of the LED is not stable, and would have a large deviation for each sub-pixel.

The deviation for the sub-pixels at low driving current would influence the displayed color. Because the sub-pixels has low luminous efficiency at low driving current.

Further, the driving circuit would occupy a relatively large area of the total available circuit area. When the image resolution greatly increase, such as 4K resolution level, the driving circuit for each sub-pixel in total would consume a large circuit area. It would cause an issue in design when the image resolution in display quality is expected be higher and higher.

SUMMARY OF THE INVENTION

Accordingly, the present invention provides the μ-LED displaying circuits, which can at least reduce the issue for color displaying at low gray level. In addition, the present invention provides the μ-LED displaying circuits which can reduce the occupation area of the driving circuit for the pixel.

In an embodiment, the invention provides a light-emitting device, comprising: a driving circuit, to provide a driving current in a frame period, according to a data signal comprising a low gray level range and a high gray level range. A light-emitting diode emits light according to the driving current from the driving circuit. A selector is coupled to the driving circuit to control the driving circuit provide the driving current. The driving current comprises a first duty cycle corresponding to the high gray level range and a second duty cycle corresponding to the low gray level range. The second duty cycle is less than the first duty cycle.

In an embodiment, the invention provides a light-emitting device (LED) displaying circuit, comprising a primary driving circuit and a pixel. The primary driving circuit receives a system high voltage, a data signal, and a scan signal from a scan line, wherein the primary driving circuit has an output terminal. The pixel comprises a plurality of light-emitting sub-pixel circuits. Each of the light-emitting sub-pixel is coupled to the output terminal of the primary driving circuit. Wherein, a frame period comprises multiple equal fields, the light-emitting sub-pixel circuits are respectively corresponding to the fields and are activated according to a sequence as assigned.

In an embodiment, as to the light-emitting device displaying circuit, the light-emitting sub-pixel circuit are activated when each of the fields is at an enabling state.

In an embodiment, as to the light-emitting device displaying circuit, the fields are respectively corresponding to different display color, and the sequence to activate the light-emitting sub-pixel circuits of the fields is same for each pixel.

In an embodiment, as to the light-emitting device displaying circuit, the fields are respectively corresponding to different display color, and the sequence to activate the light-emitting sub-pixel circuits of the fields is different for each pixel.

In an embodiment, as to the light-emitting device displaying circuit, the number of the light-emitting sub-pixel circuits is three for red, green, and blue.

In an embodiment, as to the light-emitting device displaying circuit, each of the light-emitting sub-pixel circuits comprises: a first switch transistor, having a first terminal, a second terminal, and a gate terminal, wherein the first terminal is respectively coupled to the output terminal of the primary driving circuit, wherein the gate terminal is respectively receiving an emitting control signal corresponding to one of the fields; and a LED, having an anode respectively coupled to the second terminal of the first switch transistor; and a cathode coupled to a system low voltage.

In an embodiment, as to the light-emitting device displaying circuit, the light-emitting sub-pixel circuits are activated in raw, in column or both according to a sequence as assigned, wherein a color light provided from each of the light-emitting sub-pixel circuits as activated is mixed.

In an embodiment, as to the light-emitting device displaying circuit, each of the light-emitting sub-pixel circuits comprises: a LED, having an anode respectively coupled to the output terminal of the primary driving circuit; and a cathode respectively receiving an emitting control signal corresponding to one of the fields. Wherein, one of the emitting control signals is corresponding one of the fields, and the fields are activated according to a sequence as given for each pixel.

In an embodiment, as to the light-emitting device displaying circuit, the fields are switched to a disabling state before a next one of the scan signals by a constant time.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIG. 11 is a drawing, schematically illustrating the layout of the sub-pixels in different field, according to an embodiment of the invention.

FIG. 12 is a drawing, schematically illustrating the layout of the sub-pixels in different field, according to an embodiment of the invention.

DESCRIPTION OF THE EMBODIMENTS

Figure 1:
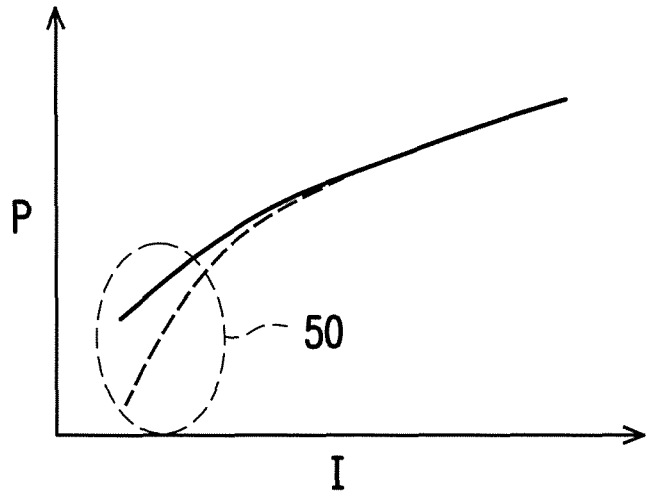
FIG. 1 is a drawing, schematically illustrating a relation between the output power (P) of LED and the driving current (I), as considered in the invention.

Reference will now be made in detail to the present preferred embodiments of the invention, examples of which are illustrated in the accompanying drawings. Wherever possible, the same reference numbers are used in the drawings and the description to refer to the same or like parts.

The invention provides multiple embodiments to describe the LED displaying circuits. However, the invention about the LED displaying circuits is not limited to the embodiment as provided. Further, the embodiments as provided can be combined as well.

The LED displaying circuits can at least reduce the issue for color displaying at low gray level and also reduce the occupation area of the driving circuit for the pixel. The descriptions in better detail are provided as follows.

FIG. 1 is a drawing, schematically illustrating a relation between the output power (P) of LED and the driving current (I), as considered in the invention. Referring to FIG. 1, a relation between the output power (P) of LED and the driving current (I) on the LED basically is a positive relation. The larger the output power (P) of the LED, the, the larger the driving current (I) of the LED. On the other hand, the stronger the driving current, the brighter the LED.

However, after looking into the actual performance in the invention, it has been found that the output power (P) of the LED within a low driving current region 50 would not be stable. Usually, the output power (P) of the LED at the low driving current region 50 is reduced as indicated by dashed line.

Figure 2:
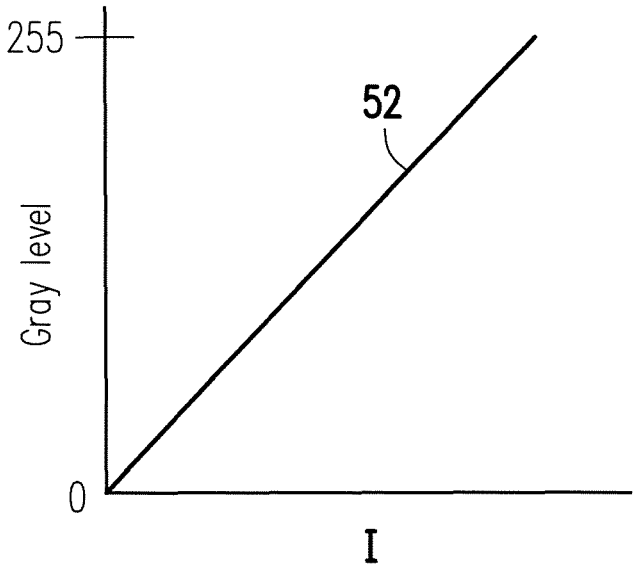
FIG. 2 is a drawing, schematically illustrating a relation between the gray level of LED and the driving current (I), as considered in the invention.

Further, as usually known, the driving current converted from the gray-level data. FIG. 2 is a drawing, schematically illustrating a relation between the gray level of LED and the driving current (I), as considered in the invention. Referring to FIG. 2, the gray-level range is ranging 0 to 255 as an example. The gray levels as the digital data are converted into the driving current to drive the LED, so to emit the light corresponding to the gray level. The relation curve 52 between the gray level and the driving current (I) ideally is linear as an example. When the gray-level of LED is in low gray-level region, the driving current is low. However, as indicated in FIG. 1 in actual operation, LED has low luminous efficiency at low driving current. It would be depending on the actual operation condition. This is one of the concerning issues, in which the insufficient luminous efficiency would occur at the low gray level or the low driving current.

The gray level for each sub-pixel in digital image is converted into a corresponding driving current according to the conversion curve 52 to drive the LED. However, even if the digital gray level is correctly converted into the driving current (I), the poor performance of the LED at the low driving current region 50 would produce the output power, correspond to brightness, less than the expected. This would influence the color as displayed. The display quality is decreasing.

Figure 3:
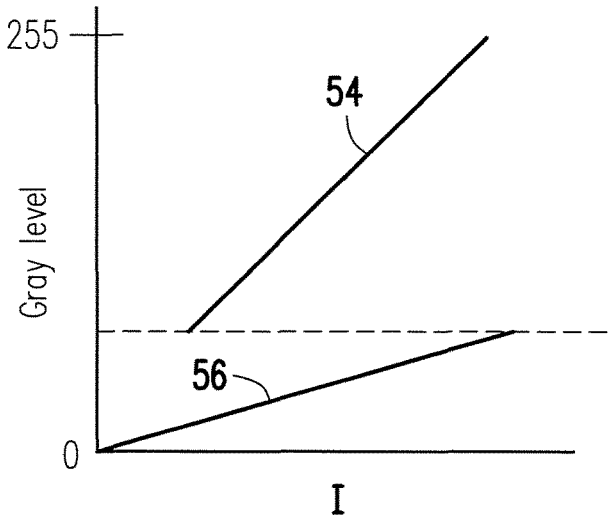
FIG. 3 is a drawing, schematically illustrating a relation between the gray level of LED and the driving current (I), according to an embodiment of the invention.

The invention in an embodiment has proposed a LED driving circuit, which can convert the gray level into driving current according to conversions curves and can compensate for low luminous efficiency at low driving current. FIG. 3 is a drawing, schematically illustrating a relation between the gray level of LED and the driving current (I), according to an embodiment of the invention.

Referring to FIG. 3, the invention divides the gray-level range into a first portion and a second portion. A portion is corresponding to the gray-level range with higher gray levels and a portion is corresponding to the gray-level range with lower gray levels. In an example for easy description, the dashed line divides gray-level range into two portions. The upper portion, higher than the dashes line, indicates the gray levels larger than a certain value, such as 63 in a full range of 0 to 255. Generally, the dashed line can be at the 50% of the maximum gray level. In further embodiment, the dashed line can be at the ⅓ or ¼ of the maximum gray level. It is depending on the actual design, in which the test measurement may also be involved to evaluate the value of the dashed line.

Once the value of the dashed line is determined, the upper portion with the gray level larger than or equal to the dashed line can be converted according to the conversion curve 54, which can be the usual curve, corresponding to the range having the normal performance at the larger driving current, as seen in FIG. 1. The lower portion with the gray level less than or equal to the dashed line can be converted according to the conversion curve 56, which is different from the usual curve with smaller slop, corresponding to the range having the poor performance at the smaller driving current, as indicated at the low driving current region 50 in FIG. 1.

In other words, the driving current (I) according to the conversion curve 52 for the low portion is larger than the driving current (I) as expected by the conversion curve 54.

So, even if the LED is displaying at the small gray level, the driving current (I) is keeping high, so the performance is more stable and increasing the luminous efficiency at low driving current. However, the higher driving current would cause larger luminance of the LED, so the duty cycle in a frame period for the low portion with the conversion curve 56 is less than or equal to 25%, or less than or equal to 50%. In the meantime, the duty cycle for the upper portion can keep at 90%-100% as an example. As a result, the total area of the driving current pulse can be kept the same as expected. In other words, the illumination is the same for the LED.

Further as to the conversion curve 54, it can be realized that the first range of gray-level, as the upper portion, is mapped from a first current level to a maximum current level. The first current level is corresponding to dashed line for determine the upper portion. As to the conversion curve 56, the second range of gray-level, as the lower portion, is mapped from a zero current level to a second current level larger than the first current level. The second current level in the example can be the maximum current level. A driving current can be determined for a given gray level, based on the conversion curve 56 at low gray level range or the conversion curve 54 at high gray level range.

Figure 4:
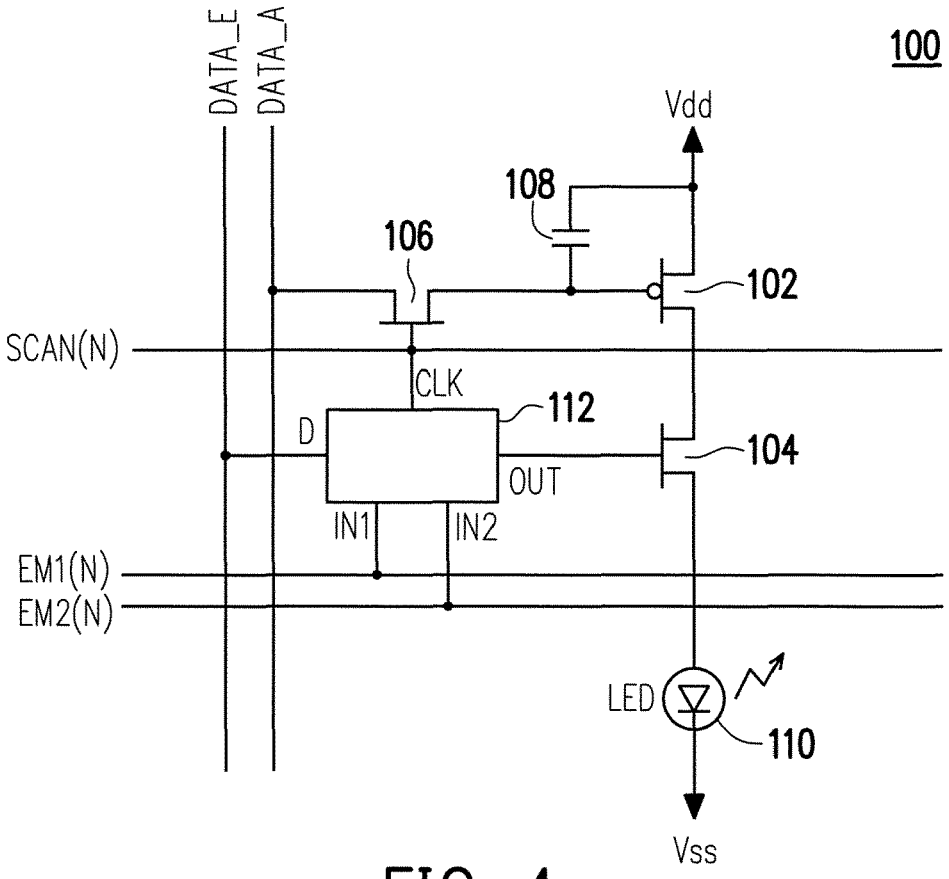
FIG. 4 is a drawing, schematically illustrating a LED displaying circuit, according to an embodiment of the invention.

Base on the mechanism of the invention above, the LED driving circuit can be designed accordingly. FIG. 4 is a drawing, schematically illustrating a LED displaying circuit, according to an embodiment of the invention. Referring to FIG. 4, the LED displaying circuit 100 in an embodiment comprises a driving circuit which comprising several transistors 102, 104, 106 and storage capacitor 108 as to be described later, a LED 110 and a selector 112. The LED can be formed using μ-LED (for example having an area less than 100 microns square or having an area small enough that it is not visible to an unaided observer of the display at a designed viewing distance) is known.

Generally, the driving circuit provides a driving current in a frame period, according to an input data signal DATA_A. The LED 110 emits a light according to the driving current from the driving circuit. The selector 112 is coupled to the driving circuit to use a first relation, such as the conversion curve 54 in FIG. 3, of gray-level versus current to control the driving circuit to produce the driving current with a first duty cycle in a frame period when a gray level of the data signal is within a first range of gray-level, such as the upper portion, and use a second relation, such as the conversion curve 56 in FIG. 3, of gray-level versus current to control the driving circuit to produce the driving current with a second duty cycle in the frame period when the gray level of the data signal is within a second range of gray-level. The second duty cycle is less than the first duty cycle.

Further, the driving circuit comprises a driving transistor 102 has a first source/drain (S/D) terminal, a second S/D terminal, and a gate terminal. The first S/D terminal receives a system high voltage Vdd. The storage capacitor 108 has a first terminal and a second terminal, wherein the first terminal is coupled to the first S/D terminal of the driving transistor 102, which is also receiving the system high voltage Vdd. The second terminal of the storage capacitor 108 is coupled to the gate terminal of the driving transistor 102. The first switch transistor 104 has a first S/D terminal, a second S/D terminal, and a gate terminal. The first S/D terminal of the first switch transistor 104 is coupled to the second S/D terminal of the driving transistor 102, and the second S/D of the first switch transistor 104 is coupled to the LED 110 to provide the driving current.

The second switch transistor 106 has a first S/D terminal, a second S/D terminal, and a gate terminal. The first S/D terminal of the second switch transistor 106 receives the input data signal DATA_A, the second S/D terminal is coupled to the gate terminal of the driving transistor 102, and the gate terminal of the second switch transistor 106 is coupled to the selector 112 and a scan line SCAN(N), where, N represents the Nth scan line, having the scan signal, which is also serving as the clock CLK.

The selector 112 receives the scan signal on the scan line SCAN(N), wherein the selector 112 further receives a digital control signal DATA_E and the terminal D, a first emitting control signal EM1(N) at the input terminal IN1 according to the first duty cycle. The selector 112 also receives a second emitting control signal EM2(N) at the second input terminal IN2 according to the second duty cycle. The selector 112 outputs a switch signal at the output terminal OUT to the gate terminal of the first switch transistor 104.

Figure 5:
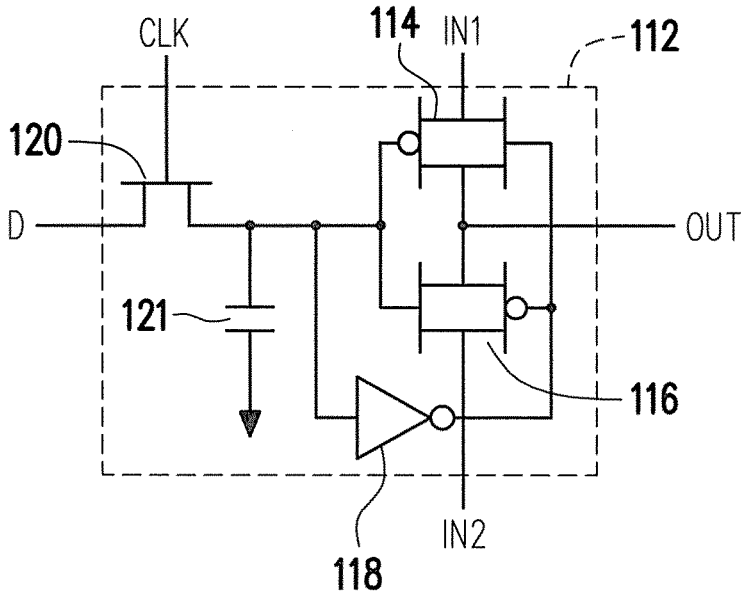
FIG. 5 is a drawing, schematically illustrating a selector circuit in FIG. 4, according to an embodiment of the invention.

The selector 112 in better detail as an example is shown in FIG. 5. FIG. 5 is a drawing, schematically illustrating a LED displaying circuit, according to an embodiment of the invention. Referring to FIG. 5, the selector 112 comprises a transistor 120, a capacitor 121, a logic inverter 118, a first pair of transistors 114, a second pair of transistors 116. One S/D terminal of the transistor 120 serves as the terminal D. The gate terminal of the transistor 120 serves receives the clock CLK. Another S/D terminal of the transistor 120 is coupled to the capacitor 121 and then to the ground or a system low voltage. The first pair of transistors 114 and the second pair of transistors 116 form a 2in-1out selector circuit, so to output the signal at the output terminal OUT to control the gate terminal of the first switch transistor 104 in FIG. 4. The selector in FIG. 5 is just an example. However, in order to select the proper duty cycle from the two duty cycles corresponding to the signals EM1(N) and EM2(N), it can be design in any proper circuit without limiting to the selector in FIG. 5.

Table 1 shows the control effect according the signal level at the terminal D and the clock CLK, so to select one of the terminal IN1 and IN2 as the output.

TABLE 1

| D | CLK | OUT |
|---|---|---|
| L | H | IN1 |
| H | H | IN2 |
| X | L | No Change |

Figure 6:
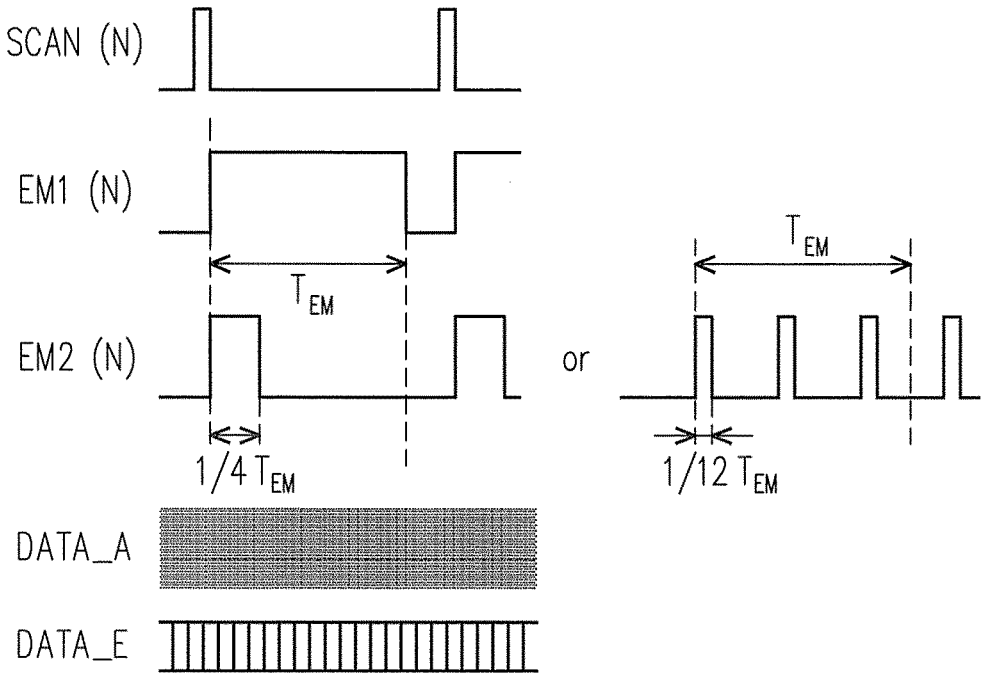
FIG. 6 is a drawing, schematically illustrating the operation mechanism with the control signals, according to an embodiment of the invention.

FIG. 6 is a drawing, schematically illustrating the operation mechanism with the control signals, according to an embodiment of the invention. Referring to FIG. 6, for example in an embodiment, the scan signal SCAN (N) has pulses to define the frame period. For the normal duty cycle $T_{EM}$ of the signal EM1 (N), such as about 90%-100%. The signal EM2 (N) is less in duty cycle than the signal EM1 (N). In an example, it can be less than or equal to ½ $T_{EM}$. In the example, it takes ¼ $T_{EM}$ as an example. However, under the same amount of duty cycle, the signal EM2 (N) can be divided into multiple pulses with one full duty cycle $T_{EM}$ with less pulse width. The input signal DATA_A is the analog signal corresponding to the gray level as expected. The signal DATA _E is a logic signal with a high level H and a low level L to have the logic operation with the clock CLK in Table 1.

Figure 7:
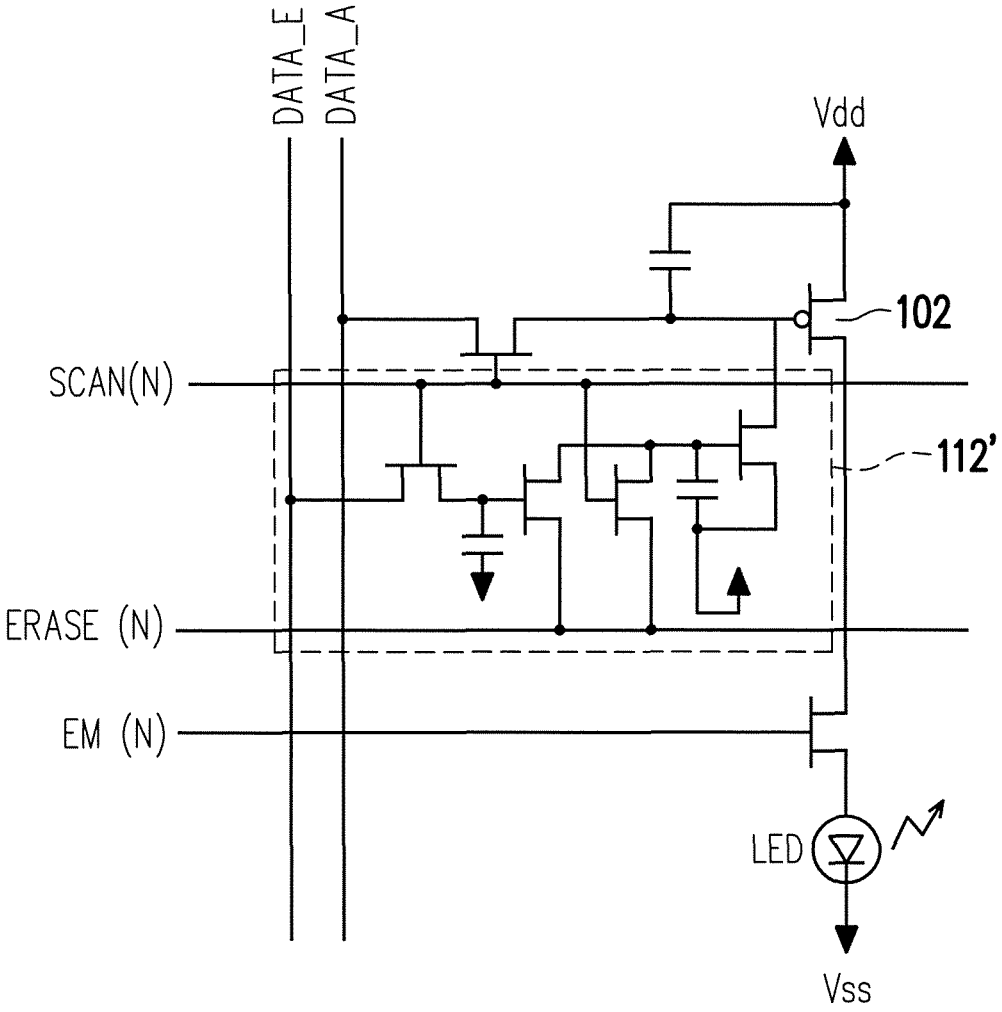
FIG. 7 is a drawing, schematically illustrating a LED displaying circuit, according to an embodiment of the invention.

The selector 112 in FIG. 4 can be further modified in another embodiment. FIG. 7 is a drawing, schematically illustrating a LED displaying circuit, according to an embodiment of the invention. Referring to FIG. 7, the selector 112' can directly control the driving transistor 102 at the gate terminal. In this operation mechanism, the proper duty cycle is triggered by an erase signal ERASE (N), in which the number of the emitting control signal EM (N) is one as usual. However, the display can be erased, such as a dark image. The operation mechanism is shown in FIG. 8.

Figure 8:
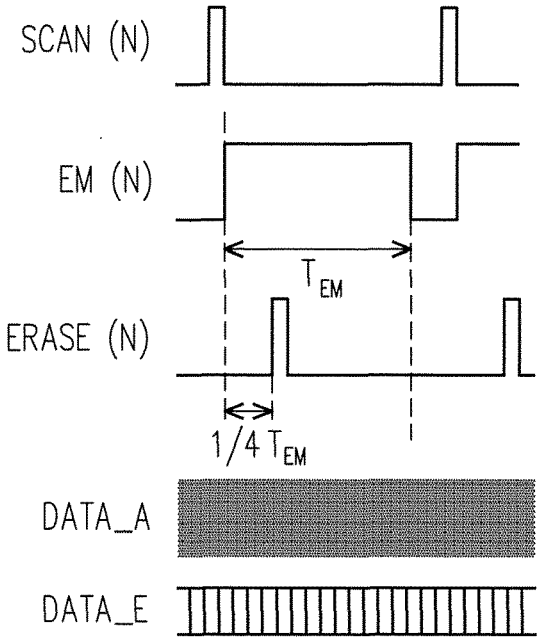
FIG. 8 is a drawing, schematically illustrating the operation mechanism with the control signals, according to an embodiment of the invention.

FIG. 8 is a drawing, schematically illustrating the operation mechanism with the control signals, according to an embodiment of the invention. Referring to FIG. 8, the scan signal SCAN (N) and the emitting control signal EM (N) can be normal. However, once the scan signal SCAN (N) triggers one frame to display the image, in which the LED emitting the light according to the given gray level. If the shorter duty cycle is intended, the erase signal ERASE (N) at the given duty cycle, such as ¼ $T_{EM}$, is set to the enabling state, so to turn off the LED. This is equivalent to the control on duty cycle. The actual circuit design for the selector 112' can be made in any circuit to perform the erasing function, without limiting to the embodiment.

After describing the LED driving circuit to improve the stability of emitting light at the low gray level and increasing the luminous efficiency at low driving current, the invention further consider the effect to reduce the circuit occupation area. Remarkably, the two effects of improving display performance and reducing the circuit occupation area can be separately implemented or combined in implement without conflicting to each other.

The effect of reducing the circuit occupation area is described in better detail as follows.

Figure 9:
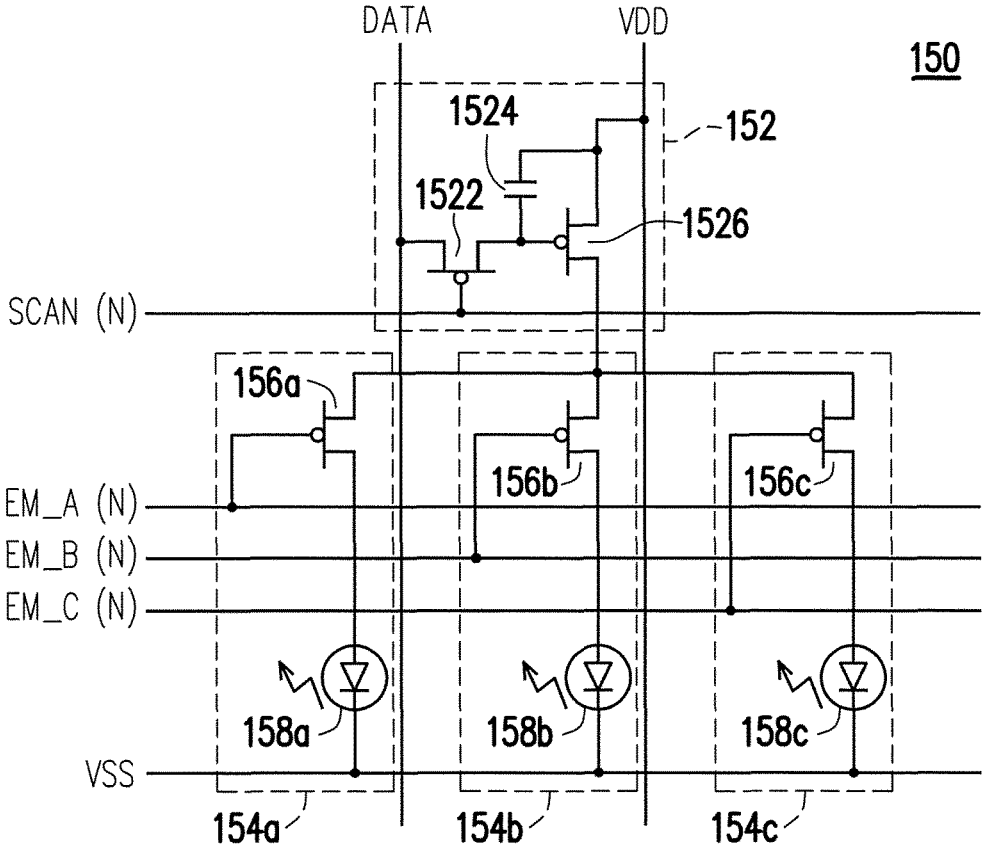
FIG. 9 is a drawing, schematically illustrating a LED displaying circuit, according to an embodiment of the invention.

FIG. 9 is a drawing, schematically illustrating a LED displaying circuit, according to an embodiment of the invention. Referring to FIG. 9, one pixel comprising multiple sub-pixels, such as three sub-pixels just needs one primary driving circuit 152, which is shared by three sub-pixels.

The LED displaying circuit 150 in an embodiment comprises a primary driving circuit 152 and a plurality of light-emitting sub-pixel circuits, such as three circuits. Each of the light-emitting sub-pixel circuits comprises the first switch transistor 156*a*, 156*b*, 156*c* and the LED 158*a*, 158*b*, 158*c*. The primary driving circuit 152 is receiving a system high voltage VDD, an input data signal DATA, and a scan signal from a scan line SCAN (N), wherein the primary driving circuit 152 has an output terminal at the S/D terminal of the transistor 1526. The light-emitting sub-pixel circuits are respectively coupled to the output terminal of the primary driving circuit 152 to form a pixel. Wherein, a frame period has multiple equal fields, the light-emitting sub-pixel circuits are respectively corresponding to the fields and are activated according to a sequence as assigned.

In better detail, the primary driving circuit 152 comprises a driving transistor 1526, a second switch transistor 1522 and a storage capacitor 1524. A S/D terminal of the driving transistor 1526 is coupled to a system high voltage VDD and also a terminal of the storage capacitor 1524. A gate terminal of the driving transistor 1526 is coupled to another terminal of the storage capacitor 1523. Another S/D terminal of the driving transistor 1526 serves as the output terminal to commonly couple to the light-emitting sub-pixel circuits. A S/D terminal of the second switch transistor 1522 is also coupled to the gate terminal of the driving transistor 1526 and also the storage capacitor 1524. Another S/D terminal of the second switch transistor 1522 receives the input data signal DATA. A gate terminal of the second switch transistor 1522 is coupled to the scan line SCAN (N). In other word, the second switch transistor 1522 has the output terminal to be commonly electrically connected to each of the light-emitting sub-pixel circuits 154*a*, 154*b*, 154*c* through the driving transistor 1526.

Each of the light-emitting sub-pixel circuits 154*a*, 154*b*, 154*c* comprises a first switch transistor 156*a*, 156*b*, 156*c* and a LED 158*a*, 158*b*, 158*c*. The number of the light-emitting sub-pixel circuits in the embodiment is three. However, it is not necessary to be limited to three and can be other number, such as two or four, or any proper number. Taking the light-emitting sub-pixel circuit 154*a* as an example to describe, it comprises a first switch transistor 156*a*, having a first source/drain (S/D) terminal, a second S/D terminal, and a gate terminal. The first S/D terminal of the first switch transistor 156*a* is coupled to the output terminal of the primary driving circuit 152. The gate terminal of the first switch transistor 156*a* receives an emitting control signal EM_A(N). This light-emitting sub-pixel circuit 154*a* in application can display one of the primary color, such as red light, corresponding to one of the multiple fields with one frame period as to be further described later. Likewise, the light-emitting sub-pixel circuit 154*b* comprises the first switch transistor 156*b* and the LED 158*b* with similar connection to the light-emitting sub-pixel circuit 154*a*. However, the gate terminal of the first switch transistor 156*b* is receiving another emitting control signal EM_B (N), corresponding to another field of the frame period. Likewise, the light-emitting sub-pixel circuit 154*c* comprises the first switch transistor 156*c* and the LED 158*c* with similar connection to the light-emitting sub-pixel circuit 154*a*. However, the gate terminal of the first switch transistor 156*c* is receiving another emitting control signal EM_C (N), corresponding to another field of the frame period. The cathode of the LED 158*a*, 158*b* and 158*c* are coupled to the system low voltage VSS.

Figure 10:
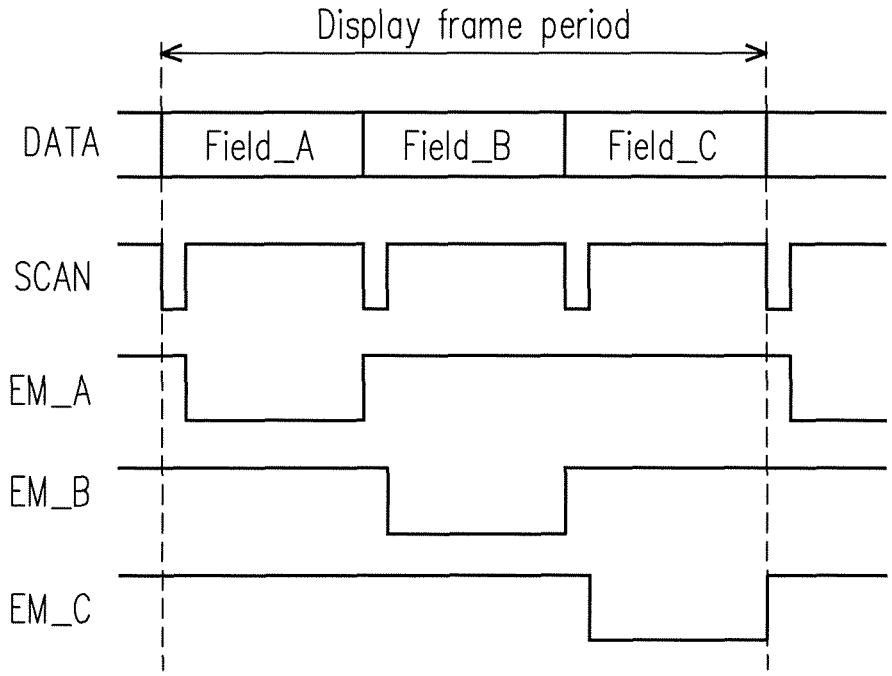
FIG. 10 is a drawing, schematically illustrating the operation mechanism with the control signals, according to an embodiment of the invention.

In operation, the emitting control signals EM_A (N), EM_B (N), EM_C (N) respectively conduct the first switch transistors 156*a*, 156*b*, 156*c* in a given time sequence, corresponding to the three fields within one frame period. FIG. 10 is a drawing, schematically illustrating the operation mechanism with the control signals, according to an embodiment of the invention.

Referring to FIG. 10, one image is displayed within one display frame period, in which red light, green light, and blue light, according to the gray levels, would form a color for each pixel. The light-emitting sub-pixel circuits 154*a*, 154*b*, 154*c* are used to generate the three primary color lights according to the emitting control signals EM_A (N), EM_B (N), EM_C (N). In other words, the frame period in an example, is divided into three time fields, such as Field_A, Field_B, and Field_C. One of the light-emitting sub-pixel circuits 154*a*, 154*b*, 154*c* is activated in one filed to display one of the primary colors, such as red, green, and blue.

Taking an example that red light is emitted during the Field_A, green light is emitted during the Field_B and blue light is emitted during the Field_C, if the emitting control signals EM_A (N), EM_B (N), EM_C (N) sequentially in time sequence active the light-emitting sub-pixel circuits 154*a*, 154*b*, 154*c*, then a red image composed from all of the pixels is displayed in Field_A, a green image composed from all of the pixels is displayed in Field_B, and a blue image composed from all of the pixels is displayed in Field_C. The three images of red, green, blue form a colour image, based on the visual effect of human eye.

With the same mechanism to display the color, in order to reduce the color interference and thereby to improve the image quality, the sequence of the emitting control signals EM_A (N), EM_B (N), EM_C (N) for different pixel can be adjusted based on the assigned time sequence. Few examples provided as follows.

FIG. 10 is a drawing, schematically illustrating the operation mechanism with the control signals, according to an embodiment of the invention. Referring to FIG. 11, during the Field_A, a first image is displayed, in which each sub-pixel does not display the same color. For the red sub-pixels indicated by R, the emitting control signal EM_A (N) activates the light-emitting sub-pixel circuits 154*a*. For the green sub-pixels indicated by G, the emitting control signals EM_A (N) activates the light-emitting sub-pixel circuits 154*b*. For the blue sub-pixels indicated by B, the emitting control signals EM_A (N) activates the light-emitting sub-pixel circuits 154*c*. However, a second image formed by another set of sub-pixels is displayed during the Field_B. Again, a third image formed by another set of sub-pixels is displayed during the Field_C. As a result, the three images displayed in the three fields of Field_A, Field_B, and Field_C form the actual image for display in one frame period. It can avoid color breakup phenomena through spatially mixing the color of driving sub-pixels in each field in row and in column by arranging the emitting control signals EM_A(N), EM_B(N), EM_C(N).

The display time sequence for the sub-pixels in each pixel can be set according to actual design, but not limited to the embodiments as provided. In further another embodiment, FIG. 12 is a drawing, schematically illustrating the layout of the sub-pixels in different field, according to an embodiment of the invention. Referring to FIG. 12, In Field_A, the red (R), blue (B) and green (G) pixels are cycled column by column. In Field_B, the green (G), red (R), and blue (B) pixels are cycled in columns. In Field_C, the blue (B), green (G), and red (R) pixels are cycled in columns. It can avoid color breakup phenomena through spatially mixing the color of driving sub-pixels in each field in column by arranging the emitting control signals EM_A(N), EM_B(N), EM_C (N). In other the array structure of color for the three fields can be arranged according to the actual need, not limited to the provided embodiments.

Figure 13:
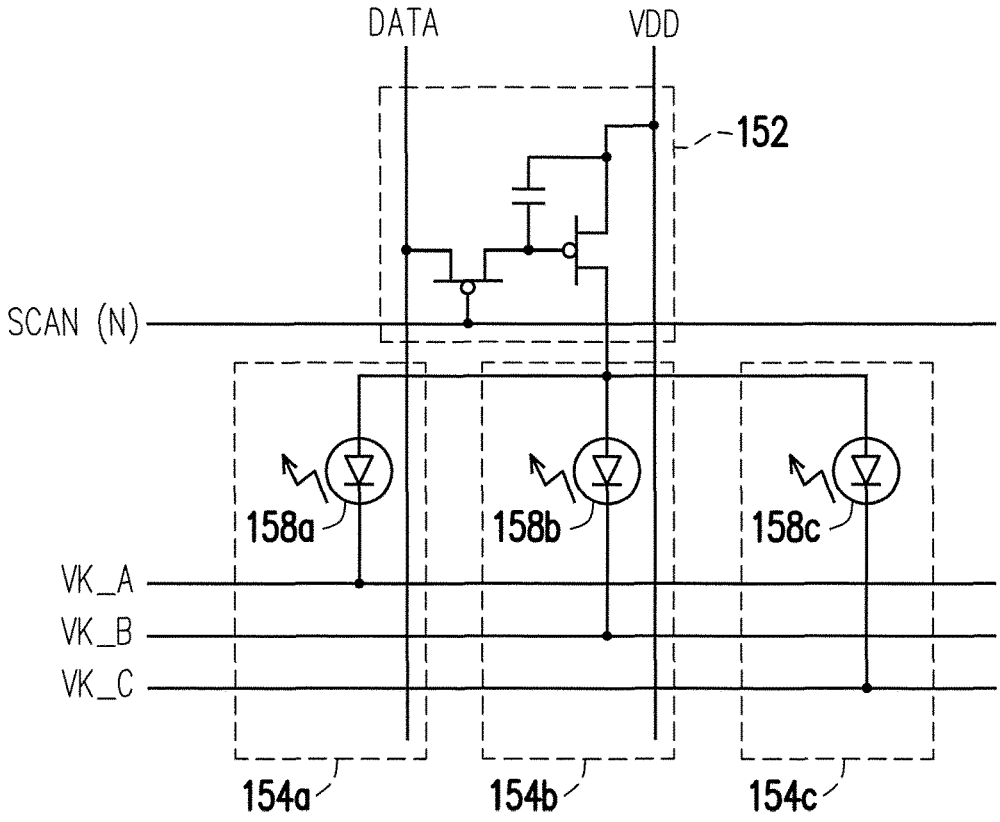
FIG. 13 a drawing, schematically illustrating a LED displaying circuit, according to an embodiment of the invention.

Further, the circuit in FIG. 9 can also be modified, based on the inventive concept to share the primary driving circuit 152. FIG. 13 a drawing, schematically illustrating a LED displaying circuit, according to an embodiment of the invention.

Referring to FIG. 13, the primary driving circuit 152 is the same as that in FIG. 9. However, the time sequence to activate the fields within one frame period can be modified. In the embodiment, each of the light-emitting sub-pixel circuits 154*a*, 154*b*, 154*c* may just comprise a LED 158*a*, 158*b*, 158*c*. Each of the LED's 158*a*, 158*b*, 158*c* has an anode respectively coupled to the output terminal of the primary driving circuit 152 and. The cathodes of the LED's 158*a*, 158*b*, 158*c* are respectively receiving the emitting control signals, now indicated by VK_A, VK_B and VK_C, corresponding to the fields. The mechanism to turn off the LED in the embodiment is setting the cathode at high voltage level or turn on the LED by setting to the ground voltage, or system low voltage VSS. The operation mechanism is described in the following.

Figure 14:
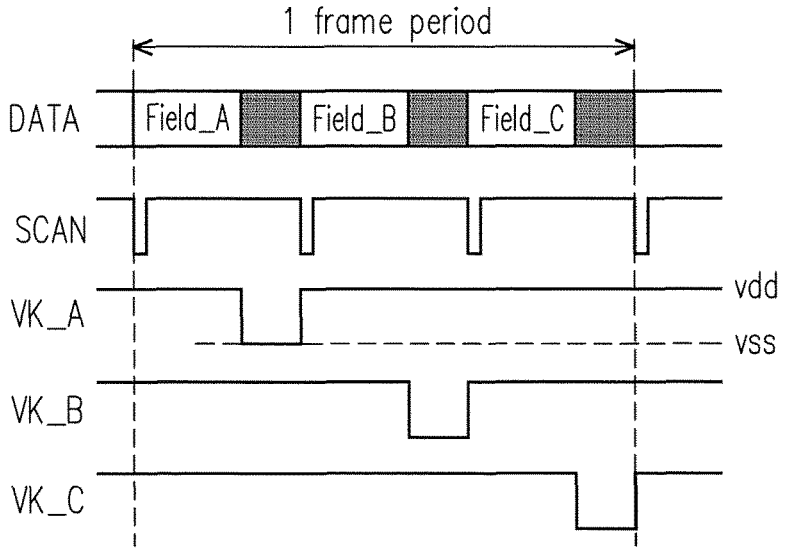
FIG. 14 is a drawing, schematically illustrating the operation mechanism with the control signals, according to an embodiment of the invention.

FIG. 14 is a drawing, schematically illustrating the operation mechanism with the control signals, according to an embodiment of the invention. Referring to FIG. 14, again, the frame period is also divided into three fields of Field_A, Field_B, and Field_C, as an example. As noted, the LED emits light when the cathode of the LED is coupled to the system low voltage VSS. According to the scan signal, each field is activated. Then, the corresponding one of the emitting control signals VK_A, VK_B, VK_C in the field is set the system low voltage VSS to display the color.

The duty cycle in each field basically can be full in an example. In this situation, the colors between two adjacent two fields are switched immediately, and may causing color interference. So, in another embodiment, the duty cycle in each field may be partial. In other word, the LED in the corresponding filed is conducted after the scan enabling signal by a certain delay from. In other words, the arrangement for the time sequence of the fields and the duty cycle in each field can be adjusted as actually needed.

As to the foregoing descriptions, the embodiments in concerning the effects of improving display performance such as FIG. 4 or FIG. 7 and reducing the circuit occupation area such as FIG. 9 and FIG. 13 can be separately implemented or combined in implement without conflicting to each other.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A light-emitting device, comprising:

a driving circuit, to provide a driving current in a frame period, according to a data signal comprising a low gray level range and a high gray level range;

a light-emitting diode, to emit light according to the driving current from the driving circuit; and a selector, coupled to the driving circuit to control the driving circuit providing the driving current;

wherein the driving current comprises a first duty cycle corresponding to the high gray level range and a second duty cycle corresponding to the low gray level range, wherein the second duty cycle is a single value;

wherein, the second duty cycle is less than the first duty cycle, wherein the driving circuit comprises:

a driving transistor, having a first terminal, a second terminal, and a gate terminal, wherein the first terminal of the driving transistor receives a first system high voltage;

a storage capacitor, having a first terminal and a second terminal, wherein the first terminal of the storage capacitor is coupled to the first terminal of the driving transistor, the second terminal of the storage capacitor is coupled to the gate terminal of the driving transistor;

a first switch transistor, having a first terminal, a second terminal, and a gate terminal, wherein the first terminal of the first switch transistor is coupled to the second terminal of the driving transistor, and the second terminal of the first switch transistor is coupled to the light-emitting diode to provide the driving current;

a second switch transistor, having a first terminal, a second terminal, and a gate terminal, wherein the first terminal of the second switch transistor receives the data signal, the second terminal of the second switch transistor is coupled to the gate terminal of the driving transistor, and the gate terminal of the second switch transistor is coupled to the selector and a scan line.

2. The light-emitting device according to claim 1, wherein the first duty cycle is 90-100 percent of the frame period and the second duty cycle is less than or equal to 50 percent of the frame period.

3. The light-emitting device according to claim 2, wherein the second duty cycle is less than or equal to 25 percent of the frame period.

4. The light-emitting device according to claim 1, wherein the high gray level range is mapped from a first current level to a maximum current level, and the low gray level range is mapped from a zero current level to a second current level larger than the first current level.

5. The light-emitting device according to claim 4, wherein the second current level is the maximum current level.

6. The light-emitting device according to claim 1, wherein the selector receives a scan signal on the scan line, wherein the selector further receives a digital control signal, a first emitting control signal according to the first duty cycle, a second emitting control signal according to the second duty cycle, and outputs a switch signal to the gate terminal of the first switch transistor.

7. The LED according to claim 1, wherein the selector receives a scan signal on the scan line, wherein the selector further receives a digital control signal and an erase signal according to the second duty cycle, wherein an emitting control signal according to the first duty cycle is received by the gate terminal of the first switch transistor, wherein an output of the selector s coupled to the gate terminal of the driving transistor to turn off the LED according to the erase signal.

* * * * *